United States Patent [19]

Rullier

[11] Patent Number: 4,889,358

[45] Date of Patent: Dec. 26, 1989

[54] FRONT BINDING FOR A SKI BOOT

[75] Inventor: Pierre Rullier, Annecy, France

[73] Assignee: Salomon S.A., Metz-Tessy, France

[21] Appl. No.: 244,085

[22] Filed: Sep. 14, 1988

[30] Foreign Application Priority Data

Sep. 18, 1987 [FR] France ..... 8712953

[51] Int. Cl.[4] ..... A63C 9/08

[52] U.S. Cl. ..... 280/628; 280/629; 280/634; 280/636

[58] Field of Search ..... 280/625, 628, 629, 634, 280/636

[56] References Cited

U.S. PATENT DOCUMENTS 3,594,014 7/1971 Salomon ..... 280/628
4,226,439 10/1980 Kirsch ..... 280/628
4,660,849 4/1987 Sedlmair et al. ..... 280/625

FOREIGN PATENT DOCUMENTS 316386 5/1974 Austria .
3612650 11/1986 Fed. Rep. of Germany .
3612696 11/1986 Fed. Rep. of Germany .
3539969 5/1987 Fed. Rep. of Germany .
2527464 12/1983 France .

*Primary Examiner*—Charles A. Marmor
*Assistant Examiner*—Brian Johnson
*Attorney, Agent, or Firm*—Sandler & Greenblum

[57] ABSTRACT

An abutment for binding a boot on a ski. The abutment includes a support affixed to the ski on which is moveably mounted a jaw for retaining the front of the boot. An elastic device is provided for normally maintaining the jaw on its support in a central engaged position. Furthermore, a linkage device is provided between the jaw and its support for frontwardly displacing an upper portion of the jaw and rearwardly displacing a lower portion of the jaw, during movement of the jaw in a lateral direction, which is substantially transverse to the ski in all lateral released positions, so as to simultaneously cause a progressive upward opening of the jaw.

49 Claims, 4 Drawing Sheets

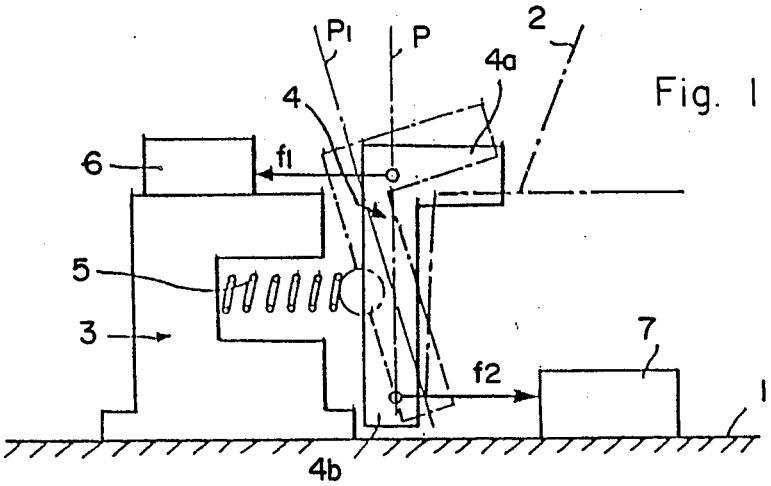
Fig. 1
Fig. 2
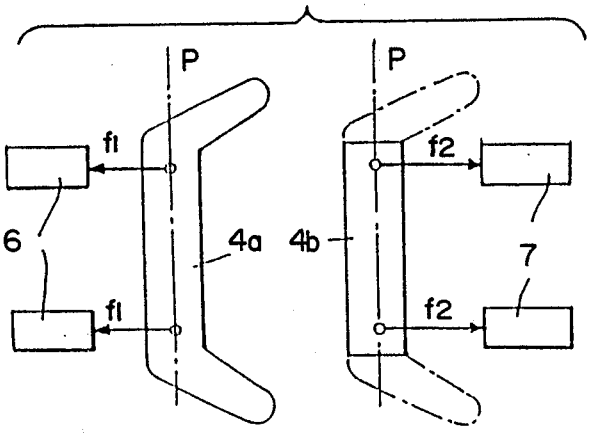
Fig. 3
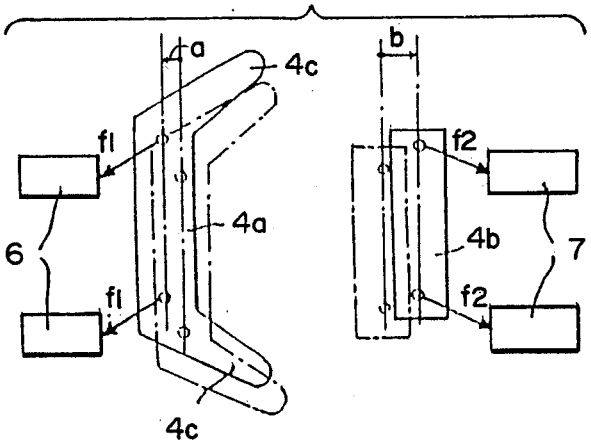

Fig. 8
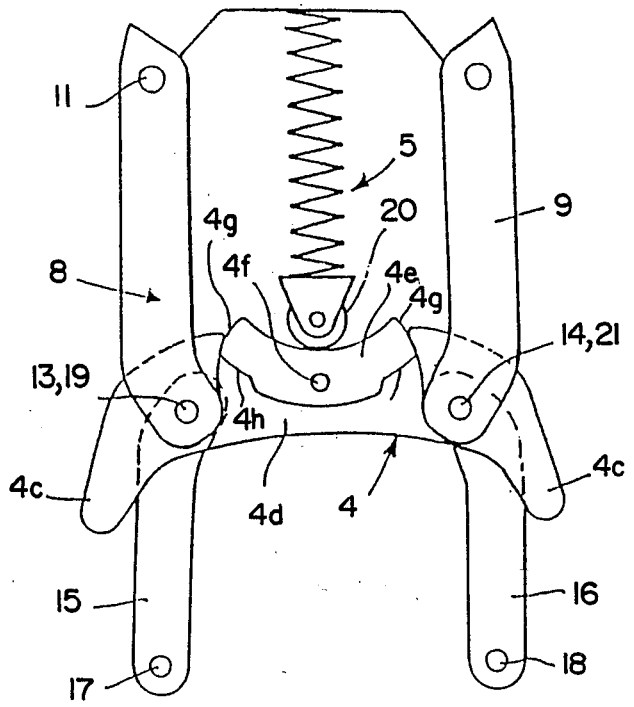
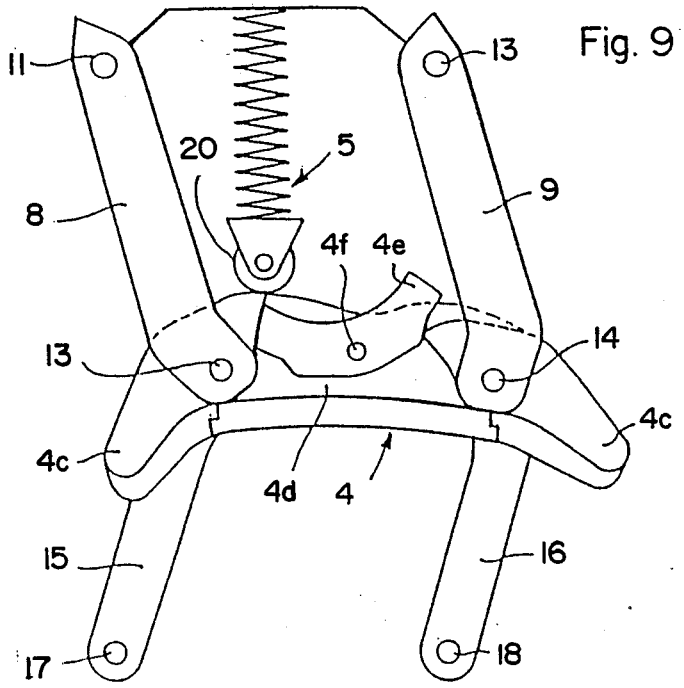
Fig. 9

FRONT BINDING FOR A SKI BOOT

BACKGROUND OF THE INVENTION

1. Field of the Invention

The present invention relates to a front abutment for securing a ski boot on a ski.

2. Description of Background and Relevant Information

Ski bindings of the "front abutment type" are mounted on a ski to retain the front of a boot when skiing, and to release the boot, when the intensity of the force applied to the binding by the boot exceeds a critical predetermined threshold. These "front abutment type" ski bindings comprise a jaw which is moveably mounted on a support affixed to the ski, and which is maintained in the engaged position by an elastic means. In the "front abutment type" ski binding to which the present invention relates, such as described in German Pat. No. A 35 39 969, the jaw is connected to the rear ends of small, front parallel rods of the same length, which are journaled, at their front ends, to two fixed points attached to the ski. These two fixed points constitute, with the two journal points of the small rods on the jaw, the four apices of a deformable parallelogram. The retention jaw of the boot has a dimension extending substantially transverse to the ski, wherein the dimension extends substantially transverse to the ski in all translational positions during release of the retention jaw.

SUMMARY OF THE INVENTION

It is an object of the present invention to provide a front abutment type sky binding that substantially reduces friction between the boot and the jaw during release of the binding whereby disengagement of the boot during release of the binding is facilitated.

The present invention achieves this objective by providing a front abutment for binding a ski boot on a ski. The front abutment is provided with support means adapted to be affixed to a ski and retention jaw means for retaining the front of the ski boot. The retention jaw means are moveably attached to the support means, and elastic means are provided for maintaining the retention jaw means in a central, engaged position. Furthermore, movement control means are provided for controlling movement of the retention jaw means between the central, engaged position and a lateral, released position. The movement control means permit the retention jaw means to have a lateral movement that is substantially transverse to the ski in all lateral released positions while displacing an upper portion of the retention jaw means in a frontward direction and a lower portion of the retention jaw means in a rearward direction, whereby there is a progressive upward opening of the retention jaw means during movement of the retention jaw means in the lateral direction.

In one embodiment of the invention, the movement control means include two parallel, front connecting elements and two parallel, rear connecting elements. The two front elements have the same length and are symmetrically positioned, in the engaged position, with respect to a longitudinal axis passing through the abutment. The two front elements each have a front end and a rear end. In this regard, the front elements are adapted to be connected at their front ends to two fixed, journal points on a ski, and are attached at their rear ends to two, moveable journal points on the upper portion of the retention jaw means, whereby the two front elements form two moveable sides of a parallelogram. The two parallel, rear connecting elements have the same length and are symmetrically positioned, in the engaged position, with respect to the longitudinal axis passing through the abutment. The two rear elements each have a front end and a rear end. In a similar manner to the front elements, the rear elements are adapted to be connected at their rear ends to two fixed, journal points on a ski, and are attached at their front ends to two, moveable journal points on the lower portion of the retention jaw means, whereby the two rear elements form two moveable sides of a parallelogram. Preferably, the front and rear elements are rods.

The front connecting elements can have the same length as the rear connecting elements or can have a different length. Furthermore, the front and rear connecting elements can be contained, in the engaged position, within the same vertical and longitudinal planes, or in different vertical and longitudinal planes.

Additionally, the moveable, journal points on the upper and lower portions of the retention jaw means can be vertically aligned, in the engaged position, in an axis passing perpendicular to the longitudinal axis passing through the front abutment. Conversely, the moveable, journal points on the upper and lower portions of the retention jaw means can be slightly horizontally offset.

In one aspect of the invention, the retention jaw means include a central portion having two lateral wings pivotably mounted thereon. A small blocking bar is pivotably mounted at a central location on said central portion between the two lateral wings. The small blocking bar is provided with two end portions against which the lateral wings bear in the engaged position to maintain the lateral wings latched. A recess portion is provided adjacent each end portion. As the retention jaw means moves laterally to the released position, one of the lateral wings pivots into a corresponding recessed portion to unlatch that lateral wing. Preferably, the two lateral wings pivot on journal points that are aligned with the moveable, journal points for the front and rear elements.

In another aspect of the invention, a foot-rest plate is journaled to each of the two rear elements. The footrest plate is mounted so that it is substantially parallel to the retention jaw means for lateral movement towards the released position in a direction that is substantially transverse to a ski.

To further reduce friction, the foot-rest plate can be provided with an endless band surrounding the plate which is adapted to roll on the ski. In another embodiment, a slide plate can be mounted on the ski for the foot-rest plate to slide upon.

Moreover, an anti-friction plate, which includes an upper surface and a columnar portion, can be provided on the ski. The sole of the boot can rest on the upper surface of the anti-friction plate while the rear elements freely pass below the upper surface.

In another embodiment of the invention, the movement control means include a pair of upper ramps and a pair of lower ramps on the support. The pair of upper ramps is symmetrical with respect to the longitudinal axis passing through the abutment, and the pair of lower ramps is symmetrical with the same axis. Each ramp has substantially the shape of an obtuse angle, with each upper ramp being frontwardly open and each lower ramp being rearwardly open. Two projections are provided on the upper portion of the retention jaw means. These two projections are symmetrical with respect to the longitudinal axis passing through the abutment and are spaced apart a distance that is equal to the spacing between the apices of the upper ramps. Similarly, two projections are provided on the lower portion of the retention jaw means. These two lower projections are symmetrical with respect to the longitudinal axis passing through the abutment and are spaced apart a distance that is equal to the spacing between the apices of the lower ramps. Accordingly, as the retention jaw means moves towards the released position, the upper ramps and projections displace the upper portion of the retention jaw means in a frontward direction and the lower ramps and projections displace the lower portion of the retention jaw means in a rearward direction.

BRIEF DESCRIPTION OF THE DRAWINGS

The present invention will now be described with reference to non-limiting examples demonstrating various embodiments thereof, with reference to the annexed drawings, in which:

FIG. 1 is a schematic elevational view of a front abutment according to the invention;

FIG. 2 is a schematic planar view of the upper and lower portions of the jaw in the engaged position;

FIG. 3 is a planar schematic view of the upper and lower portions of the jaw in the released position;

FIG. 8 is a planar view of a front abutment whose jaw comprises a central portion on which are mounted two wings which are normally latched, in the engaged position;

FIG. 9 is a planar view of the front abutment of FIG. 8 in the released position;

DESCRIPTION OF PREFERRED EMBODIMENTS

Figure 5:
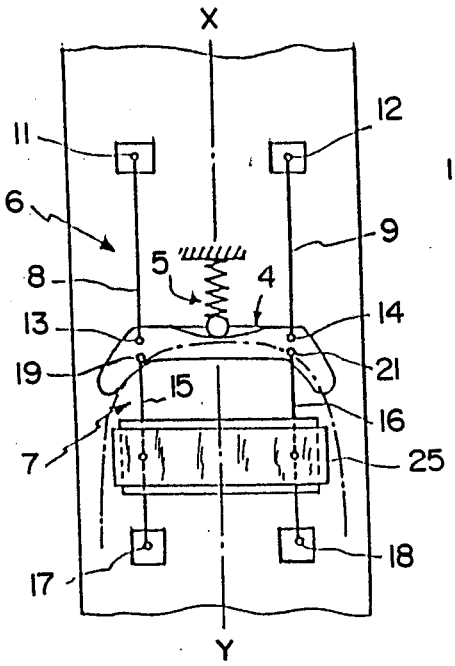
FIG. 5 is a schematic planar view of the front abutment of FIG. 4, in the engaged position.

The present invention relates to improvements to a front abutment type ski binding to substantially reduce the friction between the boot and the jaw during release of the binding 1, and thereby facilitate the disengagement of the boot during release of the safety binding.

To achieve this object, the front abutment for binding a boot onto a ski includes a support affixed to the ski. To this support is moveably mounted a retention jaw for retaining the front of the boot. Elastic means are provided to normally maintain the jaw on its support in a central, engaged position. Furthermore, linkage means, positioned between the jaw and its support, control a translational movement of the jaw in a direction that is substantially transverse to the ski during release of the binding. Specifically, the linkage means include means for frontwardly displacing the upper portion of the jaw and means for rearwardly displacing the lower portion of the jaw, to effect, during the transverse movement of the jaw, a simultaneous rocking movement of the jaw frontwardly with the resulting progressive opening of the jaw upwardly.

According to a preferred embodiment of the invention, the moveable jaw is connected to its support by means of two front, small rods. The front rods are the same length, and are symmetrical, in the engaged position, with respect to the longitudinal axis of the abutment. Furthermore, the front rods are journaled, at their front ends, on two fixed points on the ski, and at their rear ends, on two moveable journal points on an upper portion of the jaw, such that the jaw and the two front rods constitute a deformable parallelogram. At the lower portion of the jaw are journaled the front ends of two rear, small rods. These two rear rods extent from the jaw towards the rear. As with the front rods, the rear rods are parallel to each other, have the same length, and are symmetrical, in the engaged position, with respect to the longitudinal axis of the abutment. The rear ends of the two rear rods are journaled on the ski, at two fixed points, in a manner such that the jaw and the two rear rods constitute a second deformable parallelogram.

The front abutment according to the invention offers the advantage that transverse movement of the jaw, during release of the binding, is accompanied by a rocking movement of the jaw frontwardly. This rocking of the jaw occurs progressively as the jaw is laterally shifted. The resulting upward opening of the jaw makes it possible to substantially reduce the friction between the jaw and the front of the boot.

In the embodiment of the invention which is shown schematically in FIGS. 1–3, the front abutment is affixed on a ski 1 to retain the front of a boot 2 (shown in dashed lines in FIG. 1). The front abutment comprises a support 3 affixed to the ski and on which is mounted a jaw 4 adapted to assure the retention of boot 2. This jaw 4 is mounted for transverse movement on support 3, in a manner so as to allow for the freeing of boot 2 when the front abutment is in a releasing position. Jaw 4 is normally maintained in a central, engaged position by elastic means 5 of any appropriate type and in opposition to which the release of the front abutment occurs.

The moveable jaw 4 is mounted on the support 3 so as to be capable of achieving a translational movement in the transverse direction, while remaining substantially transverse to the ski. In accordance with the invention, the front abutment comprises means 6 which intervene, during transverse movement of jaw 4 during the release, to displace frontwardly, by a distance "a" (FIG. 3), the upper portion **4*a* of jaw 4, as is indicated by arrows $f_1$. The front abutment also comprises means 7 which are provided to displace towards the rear, by a distance "b" (FIG. 3), the lower portion 4*b* of jaw 4, in the direction of arrows $f_2$ during the release of the front abutment. The distance "b" can be equal to or different from the distance "a". Consequently, while in the engaged position as illustrated in FIGS. 1 and 2, jaw 4 extends along a vertical, transverse plane P. During lateral release movement of the jaw, the jaw progressively rotates, as illustrated in FIG. 3 and in dashed lines in FIG. 1, to a position which, in addition to being laterally offset, is frontwardly pivoted. Otherwise stated, jaw 4** is oriented in the released position, along a plane $P_1$ that is inclined towards the front of the ski.

This progressive inclination of the jaw 4 during release translates into a progressive opening of the jaw upwardly, thereby substantially reducing friction between the jaw 4 and boot 2. Accordingly, the front abutment according to the present invention practically eliminates interference caused by friction between the boot 2 and jaw 4.

Figure 4:
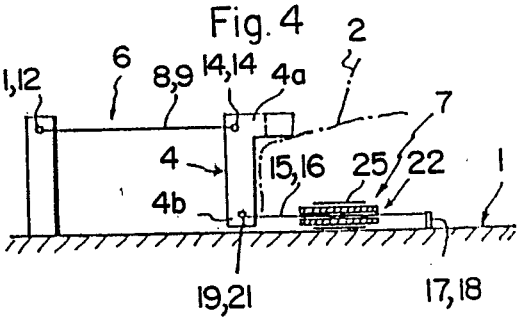
FIG. 4 is a schematic elevational view of one embodiment of the front abutment according to the invention, in the engaged position.
Figure 7:
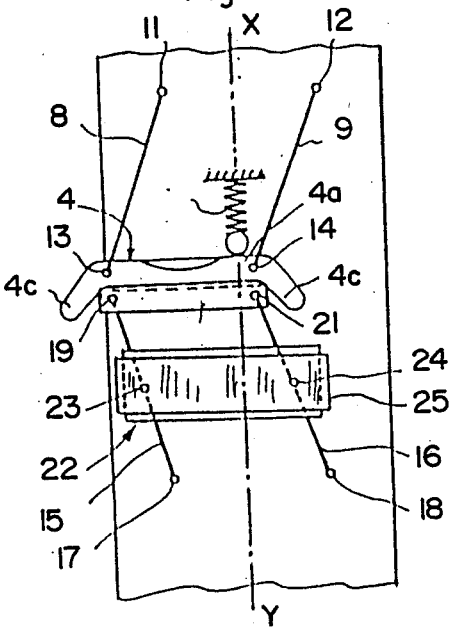
FIG. 7 is a schematic planar view of the front abutment of FIG. 6, in the released position.
Figure 6:
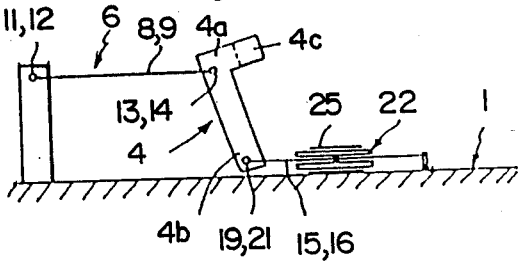
FIG. 6 is a schematic elevational view of the front abutment of FIG. 4, in the released position.

Various means can be provided for causing the rocking of jaw 4 during its lateral release. For example, in the embodiment shown in FIGS. 4–7, means 6 and 7 are utilized to achieve the frontward and rearward displacement, respectively. Specifically, the means 6, which cause the frontward displacement of the upper portion 4*a* of jaw 4, are constituted by two front, small rods 8 and 9, which are parallel to one another and of the same length. Also, the front rods are parallel to the longitudinal axis xy of the abutment in the engaged position (FIGS. 4 and 5), and are therefore symmetrical with respect to this axis. The front rods 8 and 9 are respectively journaled, at their front ends, on ski 1 at two fixed points 11 and 12 which are symmetrical with respect to the longitudinal axis xy. They are also journaled, at their rear ends, on the upper portion 4*a* of jaw 4, at two moveable upper, journaled points 33 and 14. These points 13 and 14 are symmetrical to one another with respect to the longitudinal axis xy and spaced by the same distance as the two fixed points 11 and 12. The four journal points 11, 12, 13, 14 constitute the four apices of an upper, deformable parallelogram whose two parallel, moveable sides are formed by the front rods 8 and 9.

The means 7 causing the rearward displacement of the lower portion 4*b* of jaw 4, during its transverse release movement, are constructed in the same manner as described above for means 6, having two rear small rods 15 and 16 which are parallel to one another and of the same length. These two rear rods extend parallel to the longitudinal axis xy in the engaged position, and are therefore symmetrical with respect to this axis. The two connecting rods 15 and 16 are respectively journaled at their rear ends, on ski 1, at fixed points 17 and 18. These fixed points are symmetrical with respect to the longitudinal axis xy. The rear rods are also journaled, at their front ends, on the lower portion 4*b* of jaw 4, at lower moveable journal points 19 and 21 that are symmetrical with respect to the longitudinal axis xy and spaced by the same distance as the two fixed points 11 and 12, and 17 and 18. The four journal points 17, 18, 19, 21 constitute the four apices of a lower deformable parallelogram whose two parallel, moveable sides are formed by the rear rods 15 and 16.

When jaw 4 is transversely displaced during a lateral release movement, the journal points 13 and 14, on the upper portion 4*a* of jaw 4, are displaced laterally and slightly towards the front, by virtue of the rigid linkages established by the front rods 8 and 9 with the fixed journal points 11 and 12. Simultaneously, the journal points 19 and 21 of the rear rods 15 and 16, on the lower portion 4*b* of jaw 4, are displaced laterally and slightly towards the rear, by virtue of the rigid linkages established by the rear rods 15 and 16 with the fixed journal points 17 and 18. As a result, in the released position (FIGS. 6 and 7), not only is jaw 4 laterally offset, but is slightly pivoted towards the front, i.e., open upwardly, thereby facilitating disengagement of the boot.

The rear rods 15 and 16 can have the same length as the front, small rods 8 and 9 and can be situated, in the engaged position, in the same longitudinal planes. However, this structure is not mandatory. For example, the rear rods 15 and 16 can have a different length than front rods 8 and 9, and can be situated, in the engaged position, in different longitudinal planes than front rods 8 and 9.

Furthermore, in the engaged position, the upper moveable journal points 13 and 14 can be vertically aligned with lower moveable journal points 19 and 21, or can be slightly horizontally offset.

In the embodiment of the invention shown in FIGS. 4–7, jaw 4 comprises lateral wings 4*c* which form an integral portion of the jaw and which are adapted to cap the edge of the sole of the boot. In the embodiment of the invention shown in FIGS. 8 and 9, the two lateral wings 4*c* are journaled on the central portion 4*d* of jaw 4. The elastic means 5 includes a roller or wheel 20 which engages the central portion 4*d*. The wings 4*c* are maintained latched on the central portion 4*d*, in the engaged position, by bearing against side 4*g* on a small blocking bar 4*e*. Small blocking bar 4*e* is pivotably mounted on the central portion 4*d* or jaw 4, on a vertical and central axis 4*f*. During disengagement of the front abutment, the small blocking bar 4*e* pivots around its axis 4*f* sufficiently to liberate a lateral wing 4*c* to a position where it bears against the recessed side portion 4*h* of the small blocking bar 4*e* where the release occurs, as is shown in FIG. 9. Preferably, each lateral wing 4*c* is journaled, on the central portion 4*d* of jaw 4, on an axis aligned with the journaled points of the front and rear rods of jaw 4.

At the location where the front portion of the sole of the boot rests on the ski, the front abutment can be associated with a foot-rest plate or anti-friction plate. In the embodiment shown in FIGS. 4–7, the front abutment is connected with a foot-rest plate 22 which is carried by the rear rods 15 and 16. The rods 15 and 16 pass under the foot-rest plate 22 or extend through it and there are journaled on this plate at two points 23 and 24. The points 23 and 24 are positioned so that foot rest plate 22 is substantially parallel to jaw 4 in the transverse direction. In this way, the foot-rest plate 22 can be displaced laterally as the rear rods 15 and 16 pivot, but nevertheless remains substantially transverse to the ski in all lateral released positions.

As can be seen in the drawing, the foot-rest plate 22 is preferably of the type comprising an endless band 25 wound around the plate and rolling on the ski. In this case, when the boot moves the jaw laterally, it also causes the band to rotate, and this band, while rolling on the ski, facilitates the lateral movement of the jaw by diminishing friction.

Figure 10:
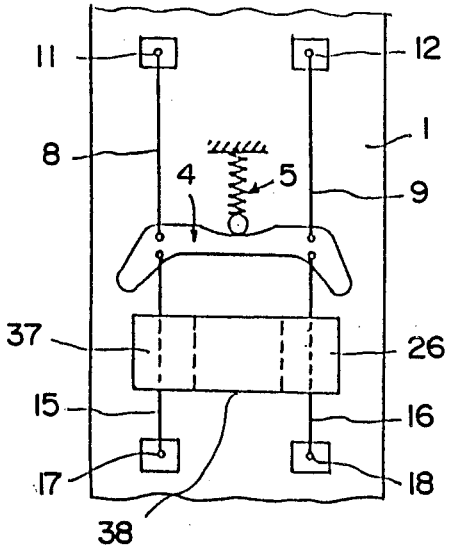
FIG. 10–13 are planar schematic views of alternative embodiments of the front abutment.
Figure 11:
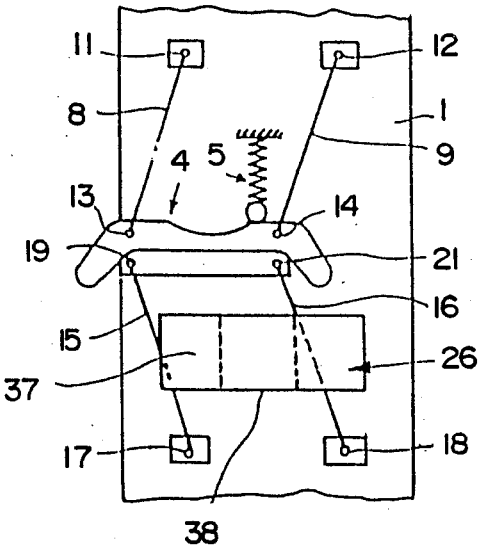

In the embodiment of the invention shown in FIGS. 10 and 11, the front abutment is associated with an anti-friction plate 26 which is affixed to the ski 1. As can be seen in FIGS. 10 and 11, the anti-friction plate 26 includes an upper surface 37 on which the sole of a ski boot rests, and a columnar portion 38 for attaching the anti-friction plate 26 to the ski. The rear rods 15 and 16 freely pass below this upper surface 37.

Figure 12:
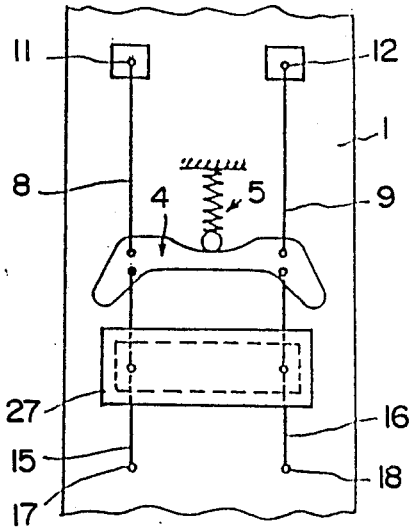
Figure 13:
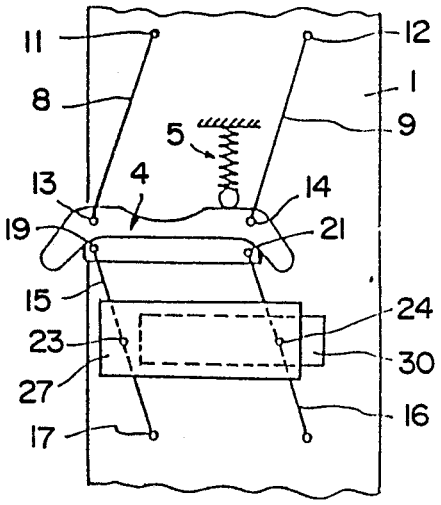

In the embodiment of the invention shown in FIGS. 12 and 13, the front abutment is connected to an anti-friction plate 27 positioned above the two rear rods 15 and 16. The rear rods 15 and 16 are journaled, at points 23 and 24, to the anti-friction plate 27. The anti-friction plate 27 and the two rear rods 15 and 16 are displaced above a lower slide plate 30 which is affixed to the ski and which can be formed, for example, out of "TEFLON" material polytetrafluoroethylene.

Figure 14:
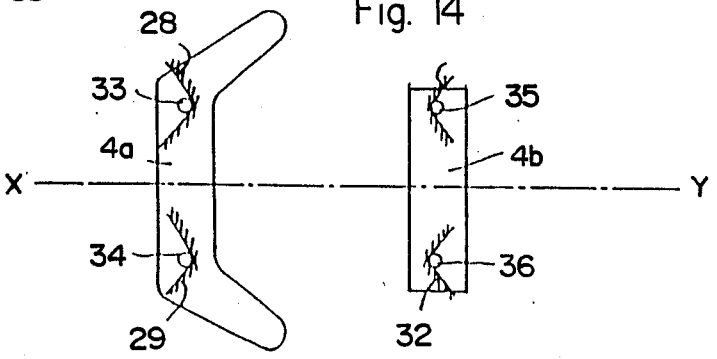
FIG. 14 is a planar schematic view of an alternative embodiment of the means adapted to displace the upper and lower portions of the jaw respectively frontwardly and rearwardly during release.

In the embodiment of the invention illustrated in FIG. 14, the means causing the displacement of the upper and lower portions 4*a* and 4*b* of the jaw 4 towards the front and towards the rear, respectively, during the transverse release movement, are constituted by upper ramps 28 and 29 and lower ramps 31 and 32 provided on the support of the jaw 4. The upper ramps 28 and 29 are symmetrical to one another with respect to the longitudinal axis xy of the abutment and they are each substantially in the shape of an obtuse angle, open towards the front. The lower ramps 31 and 32 are likewise symmetrical to one another with respect to the longitudinal axis xy, and they are each substantially in the shape of an obtuse angle open towards the rear. Cooperating with the upper ramps 28 and 29 are two projections 33 and 34, respectively. These projections 33 and 34 are carried by the upper portion 4*a* of the jaw 4 and are symmetrical with respect to the longitudinal axis xy, and are spaced from one another by the distance between the apices of the two ramps 28 and 29. Cooperating with the lower ramps 31 and 32 are two projections 35 and 36, respectively. These projections 35 and 36 are carried by the lower portion 4*b* of jaw 4, are symmetrical with respect to the longitudinal axis xy, and are spaced from one another by the distance between the apices of the two ramps 31 and 32. Consequently, when jaw 4 is displaced transversely during a release of the front abutment, the projections 33–36 slide respectively on the associated ramps 28, 29, 31, 32, with the upper projections 33, 34 being displaced towards the front while the lower projections 35 and 36 are displaced towards the rear. Accordingly, the same rocking movement of jaw 4 towards the front is obtained as in the embodiment illustrated in FIGS. 4–7. Moreover, this embodiment of the invention permits, by the appropriate choice of the values of the angles formed by ramps 31–34, a variation of the rocking movement and resulting progressive opening of the jaw 4.

Finally, although the invention has been described with reference to particular means, materials and embodiments, it is to be understood that the invention is not limited to the particulars disclosed and extends to all equivalents within the scope of the claims.

I claim:

1. A front abutment for binding a ski boot on a ski comprising a support adapted to be affixed to a ski and on which is moveably mounted a retention jaw for the front of a boot, said retention jaw having a dimension extending substantially transverse to a ski, elastic means for normally maintaining said retention jaw on said support in a central, engaged position, linkage means between said retention jaw and said support for controlling translational movement of said retention jaw, wherein said dimension extends substantially transverse to a ski in all translational positions during release of said retention jaw, and wherein said linkage means comprise first means for frontwardly displacing an upper portion of said retention jaw and second means for rearwardly displacing a lower portion of said retention jaw, during movement of said retention jaw in the transverse direction, so as to simultaneously cause a progressive upward opening of said retention jaw.

2. The front abutment according to claim 1 wherein said retention jaw is connected to said support by said first means comprising two front connecting rods which are parallel, have the same length, and are symmetrical, in said central, engaged position, with respect to a longitudinal axis of the front abutment, said two front connecting rods being adapted to be journaled, at their front ends, on two fixed points connected to a ski, and at their rear ends, to an upper portion of said retention jaw, at two journal points which are moveable in a manner such that said retention jaw and said two front connecting rods constitute a deformable parallelogram; and said second means comprising two rear connecting rods having front ends moveably journaled on a lower portion of said retention jaw, said two rear connecting rods extend towards the rear from said retention jaw, are parallel to each other, have the same length, and are symmetrical, in said central, engaged position, with respect to the longitudinal axis of the front abutment, and said two rear connecting rods have rear ends that are adapted to be connected to a ski, at two fixed points, in a manner such that said retention jaw and said two rear connecting rods constitute a second deformable parallelogram.

3. The front abutment according to claim 2 characterized in that said two rear connecting rods have the same length as said two front connecting rods.

4. The front abutment according to claim 2 characterized in that said two rear connecting rods have a length different from that of said two front connecting rods.

5. The front abutment according to claim 2 characterized in that said two rear connecting rods are contained, in said central, engaged position, in the same vertical and longitudinal planes containing said two front connecting rods.

6. The front abutment according to claim 2 characterized in that said two rear connecting rods are contained, in said central engaged position, in longitudinal and vertical planes which are different than those containing said two front connecting rods.

7. The front abutment according to claim 2 characterized in that said moveable journal points of said two front connecting rods are aligned vertically, in said central, engaged position, with said moveable journal points of said two rear connecting rods.

8. The front abutment according to claim 2 characterized in that said moveable journal points associated with said two front connecting rods are slightly offset horizontally, in said central, engaged position, with respect to said moveable journal points of said two rear connecting rods.

9. The front abutment according to claim 2 in which said retention jaw comprises a central portion on which are journaled lateral wings which are maintained latched, in said central, engaged position, by a blockage mechanism, and characterized in that each of said lateral wings is journaled, on said central portion of said retention jaw, around an axis aligned with said journal points of said two front connecting rods and said two rear connecting rods on said retention jaw.

10. The front abutment according to claim 2 further comprising a foot-rest plate which is carried by said two rear connecting rods, with said two connecting rods being journaled on said foot-rest plate at two points, whereby said foot-rest plate is mounted substantially parallel to said retention jaw for lateral movement towards the released position in a direction that is parallel with itself.

11. The front abutment according to claim 10, characterized in that said foot-rest plate includes an endless wound band adapted to roll on a ski.

12. The front abutment according to claim 10 characterized in that said foot-rest plate is capable of resting on a slide plate affixed to a ski.

13. The front abutment according to claim 2 further comprising an anti-friction plate adapted to be affixed to a ski, and across which said two rear connecting rods are capable of passing.

14. The front abutment according to claim 1 characterized in that said first means for frontwardly displacing an upper portion of said retention jaw and said second means for rearwardly displacing a lower portion of said retention jaw are constituted by upper ramps and lower ramps provided on said support for said retention jaw, said upper ramps are symmetrical to one another, with respect to a longitudinal axis of the front abutment, and each having substantially the shape of an obtuse angle open towards the front, said lower ramps are likewise symmetrical to one another with respect to the longitudinal axis of the front abutment, and each having substantially the shape of an obtuse angle open towards the rear, said upper ramps cooperate with two projections carried by said upper portion of said retention jaw, which two projections are symmetrical with respect to the longitudinal axis of the front abutment while being spaced from one another by the distance between apices of said two upper ramps, and said lower ramps cooperate with two projections carried by said lower portion of said retention jaw, which two projections are symmetrical with respect to the longitudinal axis of the front abutment, while being spaced from one another by the distance between apices of said two lower ramps.

15. The front abutment according to claim 1 in combination with a ski.

16. A front abutment for binding a ski boot on a ski comprising:

means for support adapted to be affixed to a ski;

retention jaw means for retaining the front of a ski boot, said retention jaw means having a dimension extending substantially transverse to a ski, and said retention jaw means being moveably attached to said means for support;

elastic means for maintaining said retention jaw means in a central, engaged position; and movement control means for controlling movement of said retention jaw means between said central, engaged position and a lateral, released position, said movement control means permitting said retention jaw means to have a lateral movement wherein said dimension extends substantially transverse to a ski in all lateral, released positions while displacing an upper portion of said retention jaw means in a frontward direction and a lower portion of said retention jaw means in a rearward direction, whereby there is a progressive upward opening of said retention jaw means during movement of said retention jaw means in the lateral direction.

17. The front abutment according to claim 16, wherein said movement control means comprise:

two parallel, front connecting elements, said two front connecting elements having the same length and being symmetrically positioned, in said central, engaged position, with respect to a longitudinal axis passing through the front abutment, said two front connecting elements each having a front end and a rear end, said two front connecting elements being adapted to be connected at their front ends to two fixed, journal points on a ski, and said two front connecting elements being attached at their rear ends to two, moveable journal points on said upper portion of said retention jaw means, whereby said two front connecting elements form two moveable sides of a parallelogram;

two parallel, rear connecting elements, said two rear connecting elements having the same length and being symmetrically positioned, in said central, engaged position, with respect to the longitudinal axis passing through the front abutment, said two rear connecting elements each having a front end and a rear end, said two rear connecting elements being adapted to be connected at their rear ends to two fixed, journal points on a ski, and said two rear connecting elements being attached at their front ends to two, moveable journal points on said lower portion of said retention jaw means, whereby said two rear connecting elements form two moveable sides of a parallelogram.

18. The front abutment according to claim 17, wherein:

said two front connecting elements have the same length as said two rear connecting elements.

19. The front abutment according to claim 17, wherein:

said two front connecting elements have a different length than said two rear connecting elements.

20. The front abutment according to claim 18, wherein:

said two front connecting elements and said two rear connecting elements are contained, in said central, engaged position, within the same vertical and longitudinal planes, respectively.

21. The front abutment according to claim 19, wherein:

said two front connecting elements and said two rear connecting elements are contained, in said central, engaged position, within the same vertical and longitudinal planes, respectively.

22. The front abutment according to claim 18, wherein:

said two front connecting elements and said two rear connecting elements are contained, in said central, engaged position, in different vertical and longitudinal planes.

23. The front abutment according to claim 19, wherein:

said two front connecting elements and said two rear connecting elements are contained, in said central, engaged position, in different vertical and longitudinal planes.

24. The front abutment according to claim 18, wherein:

said moveable, journal points on said upper portion and said moveable, journal points on said lower portion of said retention jaw means are vertically aligned, in said central, engaged position, in an axis passing perpendicular to the longitudinal axis passing through the front abutment.

25. The front abutment according to claim 19, wherein:

said moveable, journal points on said upper portion and said moveable, journal points on said lower portion of said retention jaw means are vertically aligned, in said central, engaged position, in an axis passing perpendicular to the longitudinal axis passing through the front abutment.

26. The front abutment according to claim 18, wherein:

said moveable, journal points on said upper portion and said moveable, journal points on said lower portion of said retention jaw means, in said central, engaged position, are slightly offset horizontally.

27. The front abutment according to claim 19, wherein:

said moveable, journal points on said upper portion and said moveable, journal points on said lower portion of said retention jaw means, in said central, engaged position, are slightly offset horizontally.

28. The front abutment according to claim 17, wherein:

said two front connecting elements and said two rear elements comprise rods.

29. The front abutment according to claim 16, wherein said retention jaw means include:

a central portion;

two lateral wings pivotably mounted on said central portion; and a small blocking bar pivotably mounted at a central location on said central portion between said two lateral wings, said small blocking bar including two end portions against which said two lateral wings bear in said central, engaged position to thereby maintain said two lateral wings latched, and said small blocking bar including a recessed portion adjacent each end portion into which recessed portion a respective one of said two lateral wing pivots to unlatch that lateral wing as said retention jaw means moves laterally to the released position.

30. The front abutment according to claim 17, wherein said retention jaw means include:

a central portion;

two lateral wings pivotably mounted on said central portion; and a small blocking bar pivotably mounted at a central location on said central portion between said two lateral wings, said small blocking bar including two end portions against which said two lateral wings bear in said central, engaged position to thereby maintain said two lateral wings latched, and said small blocking bar including a recessed portion adjacent each end portion into which recessed portion a respective one of said two lateral wing pivots to unlatch that lateral wing as said retention jaw means moves laterally to the released position.

31. The front abutment according to claim 28, wherein said retention jaw means include:

a central portion;

two lateral wings pivotably mounted on said central portion; and a small blocking bar pivotably mounted at a central location on said central portion between said two lateral wings, said small blocking bar including two end portions against which said two lateral wings bear in said central, engaged position to thereby maintain said two lateral wings latched, and said small blocking bar including a recessed portion adjacent each end portion into which recessed portion a respective one of said two lateral wing pivots to unlatch that lateral wing as said retention jaw means moves laterally to the released position.

32. The front abutment according to claim 30, wherein:

said two lateral wings pivot on journal points that are aligned with said moveable journal points for said two front connecting elements and said two rear connecting elements.

33. The front abutment according to claim 31, wherein:

said two lateral wings pivot on journal points that are aligned with said moveable journal points for said two front connecting elements and said two rear connecting elements.

34. The front abutment according to claim 17, further including:

a foot-rest plate journaled to each of said two rear connecting elements, wherby said foot-rest plate is mounted substantially parallel to said retention jaw means for lateral movement towards the released position in a direction that is substantially parallel to itself.

35. The front abutment according to claim 28, further including:

a foot-rest plate journaled to each of said two rear connecting elements, wherby said foot-rest plate is mounted substantially parallel to said retention jaw means for lateral movement towards the released position in a direction that is substantially parallel to itself.

36. The front abutment according to claim 30, further including:

a foot-rest plate journaled to each of said two rear connecting elements, wherby said foot-rest plate is mounted substantially parallel to said retention jaw means for lateral movement towards the released position in a direction that is substantially parallel to itself.

37. The front abutment according to claim 32, further including:

a foot-rest plate journaled to each of said two rear connecting elements, wherby said foot-rest plate is mounted substantially parallel to said retention jaw means for lateral movement towards the released position in a direction that is substantially parallel to itself.

38. The front abutment according to claim 36, wherein:

said foot-rest plate includes an endless band which band is adapted to roll on a ski.

39. The front abutment according to claim 37, wherein:

said foot-rest plate includes an endless band which band is adapted to roll on a ski.

40. The front abutment according to claim 34 further including:

a slide plate for connection to a ski, upon which said foot-rest plate is adapted to slide.

41. The front abutment according to claim 35 further including:

a slide plate for connection to a ski, upon which said foot-rest plate is adapted to slide.

42. The front abutment according to claim 36 further including:

a slide plate for connection to a ski, upon which said foot-rest plate is adapted to slide.

43. The front abutment according to claim 37 further including:

a slide plate for connection to a ski, upon which said foot-rest plate is adapted to slide.

44. The front abutment according to claim 17 further including:

an anti-friction plate including an upper surface and a columnar portion, wherein said anti-friction plate is adapted to be connected to a ski so that said two rear connecting elements can freely pass below said upper surface of said anti-friction plate.

45. The front abutment according to claim 28 further including:

an anti-friction plate including an upper surface and a columnar portion, wherein said anti-friction plate is adapted to be connected to a ski so that said two rear connecting elements can freely pass below said upper surface of said anti-friction plate.

46. The front abutment according to claim 30 further including:

an anti-friction plate including an upper surface and a columnar portion, wherein said anti-friction plate is adapted to be connected to a ski so that said two rear connecting elements can freely pass below said upper surface of said anti-friction plate.

47. The front abutment according to claim 32 further including:

an anti-friction plate including an upper surface and a columnar portion, wherein said anti-friction plate is adapted to be connected to a ski so that said two rear connecting elements can freely pass below said upper surface of said anti-friction plate.

48. The front abutment according to claim 16, wherein said movement control means comprise:

a pair of upper ramps on said means for support, said pair of upper ramps being symmetrical with respect to a longitudinal axis passing through the front abutment, and having substantially the shape of an obtuse angle which is frontwardly open;

a pair of lower ramps on said means for support, said pair of lower ramps being symmetrical with respect to the longitudinal axis passing through the front abutment, and having substantially the shape of an obtuse angle which is rearwardly open;

two projections on said upper portion of said retention jaw means, said two projections being symmetrical with respect to the longitudinal axis passing through the front abutment and spaced apart a distance that is equal to spacing between apices of said upper ramps;

two projections on said lower portion of said retention jaw means, said two projections being symmetrical with respect to the longitudinal axis passing through the front abutment and spaced apart a distance that is equal to spacing between apices of said lower ramps;

whereby, as said retention jaw means moves toward the released position, said upper ramps and two projections on said upper portion displace said upper portion of said retention jaw means in a frontward direction and said lower ramps and said two projections on said lower portion displace said lower portion of said retention jaw means in a rearward direction.

49. The front abutment according to claim 16 in combination with a ski.

* * * * *

UNITED STATES PATENT AND TRADEMARK OFFICE

CERTIFICATE OF CORRECTION

PATENT NO. : 4,889,358

DATED : December 26, 1989

INVENTOR(S) : Pierre RULLIER

It is certified that error appears in the above-identified patent and that said Letters Patent is hereby corrected as shown below:

Column 1, line 34, change "sky" to ---ski---.
Column 3, line 45, change "FIG" to ---FIGS---.
Column 4, line 18, change "extent" to ---extend---.
Column 5, line 24, change "33" to ---13---.
Column 6, line 21, change "or" to ---of---.
Column 6, line 38, change "there" to ---they---.
Column 6, line 68, change "polytetrafluoroethylene" to ---(polytetrafluoroethylene)---.
Column 12, line 10 (claim 34, line 4), change "wherby" to ---whereby---.
Column 12, line 18 (claim 35, line 4), change "wherby" to ---whereby---.
Column 12, line 27 (claim 36, line 4), change "wherby" to ---whereby---.
Column 12, line 35 (claim 37, line 4), change "wherby" to ---whereby---.

Signed and Sealed this

Twenty-ninth Day of December, 1992

*Attest:*

DOUGLAS B. COMER

*Attesting Officer*

*Acting Commissioner of Patents and Trademarks*